US006003733A

United States Patent [19]

Wheeler

[11] Patent Number: 6,003,733

[45] **Date of Patent: *Dec. 21, 1999**

[54] APPARATUS FOR THE DISPENSING OF HEATED VISCOUS FOOD PRODUCT

[75] Inventor: James R. Wheeler, Pleasanton, Calif.

[73] Assignee: Compass Worldwide, Louisville, Ky.

[ * ] Notice: This patent is subject to a terminal disclaimer.

[21] Appl. No.: 09/135,135

[22] Filed: Aug. 17, 1998

Related U.S. Application Data

[63] Continuation-in-part of application No. 08/681,186, Jul. 22, 1996, Pat. No. 5,803,317

[60] Provisional application No. 60/078,481, Mar. 18, 1998.

[51] Int. Cl.[6] ..... B67D 5/62

[52] U.S. Cl. ..... 222/146.5; 222/214

[58] Field of Search ..... 222/214, 333, 222/494, 146.5

[56] References Cited

U.S. PATENT DOCUMENTS

| | | | |
|---|---|---|---|
| 3,212,681 | 10/1965 | Weikert . | |
| 3,297,206 | 1/1967 | Scholle . | |
| 3,520,451 | 7/1970 | Ashizawa . | |
| 4,094,446 | 6/1978 | Brutsman . | |
| 4,141,474 | 2/1979 | Nilson | 222/493 |
| 4,544,085 | 10/1985 | Frazer . | |
| 4,651,898 | 3/1987 | Bell . | |
| 4,717,047 | 1/1988 | Van Overbruggen et al. . | |
| 4,796,788 | 1/1989 | Bond . | |
| 4,941,597 | 7/1990 | Lopez et al. . | |
| 5,000,351 | 3/1991 | Rudick . | |
| 5,040,700 | 8/1991 | Compton . | |
| 5,102,015 | 4/1992 | Barnard et al. . | |
| 5,142,610 | 8/1992 | Augustine et al. . | |
| 5,249,706 | 10/1993 | Szabo . | |
| 5,349,825 | 9/1994 | Duke et al. . | |
| 5,353,963 | 10/1994 | Gorski et al. . | |
| 5,366,308 | 11/1994 | Crispino . | |

*Primary Examiner*—Gregory L. Huson
*Attorney, Agent, or Firm*—Wheat, Smith & Bres, PLC; Vance A. Smith; David W. Nagle, Jr.

[57] ABSTRACT

A dispenser for dispensing viscous products at elevated temperatures includes a receptacle for receiving a bag of product having a flexible discharge tube therefrom, or in the alternative, includes a receptacle that has a flexible discharge tube. A peristaltic pump is secured beneath the receptacle to force the movement of food product throughout the discharge tube. A heating assembly is positioned within the receptacle and heats the air. A fan circulates the air about the receptacle and tube so as to maintain the temperature of the food product at a level to permit free flowing of the product from the bag throughout the tube.

15 Claims, 6 Drawing Sheets

APPARATUS FOR THE DISPENSING OF HEATED VISCOUS FOOD PRODUCT

This application claims priority from U.S. provisional application 60/078,481, filed Mar. 18, 1998 and is a continuation-in-part of commonly assigned and co-pending U.S. application Ser. No. 08/681,186 filed Jul. 22, 1996, which issued as U.S. Pat. No. 5,803,317 on Sep. 8, 1998.

BACKGROUND OF THE INVENTION

The present invention relates to an apparatus for dispensing viscous fluids, particularly food products.

In the food service industry, there are a wide variety of devices that are used to dispense viscous food products. Such dispensers are commonly found in restaurants, convenience stores, and other commercial eating establishments. Many viscous products, such as cheese sauces and ice cream toppings, do not flow well at room temperature, so these dispensers are often heated to maintain the product in a flowable condition.

A typical heated dispenser uses a pump, and a connecting nozzle tube to transfer the product from a heated product container housed within the dispenser to the user. The food product travels from the receptacle, through the nozzle tube, and is dispensed by the opening a valve at the nozzle. The use of such a dispensing apparatus, however, has a number of disadvantages. Because the pump, receptacle, and nozzle, are in direct contact with the food product, each must frequently be dismantled and cleaned because of concern over contamination and bacterial spoilage, especially when the dispenser is used with dairy products. Many state health laws often mandate a daily cleaning of dispensers which store and dispense dairy products.

Products most often used in the dispensers become more viscous and tend to congeal as they cool. To properly clean the pump following use, the pump frequently must be soaked to loosen encrusted materials. The shape of the pump often makes it extremely difficult to rid the pump of all particles, thus providing an excellent growth habitat for pathogens. Similarly, the nozzle being of small diameter is difficult to clean. This problem is exacerbated by the prior art devices heating the nozzle during operation causing the food product to strongly adhere to the insides surface of the nozzle. Proper cleaning of the nozzle is difficult because of the collected product build-up and the shape of the nozzle. Moreover, the exterior end of the nozzle, which extends outwardly from the dispenser, is typically comprised of stainless steel, a good conductor of heat. The hot nozzle is capable of injuring the unwary user of the dispenser.

Overall cleaning of the dispenser cannot be accomplished without considerable downtime caused, for example, by withdrawing the pump subassembly from within the product receptacle. Ordinarily, the pump subassembly is located inside the dispenser and has one end of the nozzle tube attached to it. Dismantling of many dispenser parts is required to remove the pump subassembly in order to clean the product receptacle. Any electrical connection, waterproof or otherwise, inhibits this cleaning operation. Finally, the pump, receptacle, and nozzle are in direct contact with the food product; therefore, they must be made of material such as stainless steel that is accepted by the authorities for being in contact with the food product.

Attempts have been made to address some of these concerns by using the bag-in-box technology common in the beverage dispensing industry. For example, soft drink syrups, bulk milk, and wine is packaged in flexible bags.

These packages have been successfully used for holding and dispensing liquids which will flow readily at room temperature when the dispensing valve is opened. However, they have not worked well for containing and dispensing viscous products which will not readily flow under the force of gravity.

When bag-in-box packages are used for viscous products, pumps, pressure chambers, or similar equipment is needed to force the food product from the bag. An example of the pressure chamber used with a bag-in-box type of apparatus is found in U.S. Pat. No. 4,796,788, issued Jan. 10, 1989, and assigned to Liqui-Box Corporation. Such dispensers, however, have their own attendant disadvantages, including the expense of moving the food product.

In the aforementioned co-pending and commonly assigned U.S. patent Ser. No. 08/681,186, now U.S. Pat. No. 5,803,317 an alternative system for dispensing viscous food products was introduced that incorporates the use of a peristaltic type of pump. The viscous food product is packaged in a flexible bag having an elongated discharge tube extending therefrom. The dispenser includes a receptacle having an outlet opening in the front, lower portion thereof. The sealed food product container is seated in the receptacle so that the discharge tube extends from the front, lower portion of the receptacle through the outlet opening. The pump is secured beneath the receptacle so that the discharge tube passes through the pump, and cooperates with the discharge tube to provide flow of the food product. The pump described in the co-pending application is a peristaltic pump that uses a rotor which driven at a predetermined speed by an electric motor. A plurality of pinch rollers are mounted on the periphery of the rotor and rotate about axes parallel to the axis of rotation of the rotor. The discharge tube is supported by an arcuate stator positioned near the rotor periphery. Thus, as the rotor rotates, the individual pinch rollers progressively impinge on the discharge tube, compressing the discharge tube against the stator, creating a peristaltic movement of the food product within the discharge tube. In this manner, a predetermined volume of food product is moved axially through the discharge tube and is dispensed at a rate determined by the speed of rotation of the rotor.

In the dispenser described in the aforementioned co-pending application, the food product is heated by conduction through the material of the receptacle including structure encompassing the tube. The portion of the receptacle adjacent the product bag is made of a heat-conducting material and is heated by an electric heater positioned within the dispenser. Additionally, the portions of the dispenser adjacent the discharge tube are made of a heat-conducting material to ensure that product within the discharge tube is also maintained at the proper temperature and that the food material is free flowing at all points within the dispenser, including those portions of the elongated tube most remote from the receptacle. These portions may be heated through conduction from the walls of the receptacle or by a separate heating element.

The heating of the food product by conduction, however, does not always provide optimal uniform heating and may also make the internal and external receptacle surfaces extremely hot. Such hot surfaces increase the difficulty of handling the dispenser.

Therefore, it is an object of the present invention to provide for a viscous food dispenser that heats the food product at all points during the passage of the food product from the receptacle to the point of exit from the receptacle, thereby ensuring the food product remains in a free flowing state.

It is another object of the present invention to provide for a heated viscous food dispenser that reduces the likelihood that a user will come into contact with extremely hot surfaces.

It is a further object of the present invention to provide for a heated viscous food dispenser that provides for more uniform heating of the food product while resident within the dispenser.

It is still a further object of the present invention to provide a receptacle that is easily removed from the dispenser for simple loading of the food product and cleaning.

The foregoing and other objects and advantages will become apparent to those skilled in the art upon a reading of the following description of a preferred embodiment of the present invention.

SUMMARY OF THE INVENTION

The present invention is generally directed to the dispensing of a liquid or viscous food product, and is particularly advantageous when the product to be dispensed does not flow well at room temperature but flows easier at an elevated temperature. Food products that may be dispensed by this invention include cheese sauce, dessert toppings, and syrups. Such food products are often contained in a flexible bag that is housed within the dispenser. The bag is connected to and communicates with the exterior of the dispenser by a flexible hose. The food stuff is moved and dispensed by controlled peristaltic action on the flexible hose. Substantially, the entire bag and flexible hose is heated by convection, thereby providing more uniform heating of the food product, ensuring the product is in a free-flowing state at all points of its passage from receptacle through the tube, and eliminating the need for heat-conducting surfaces. The dispenser of the present invention also has a removable receptacle constructed to facilitate the convection heating of the bag and loading of the food product within the dispenser.

DESCRIPTION OF THE PREFERRED EMBODIMENTS

Figure 1:
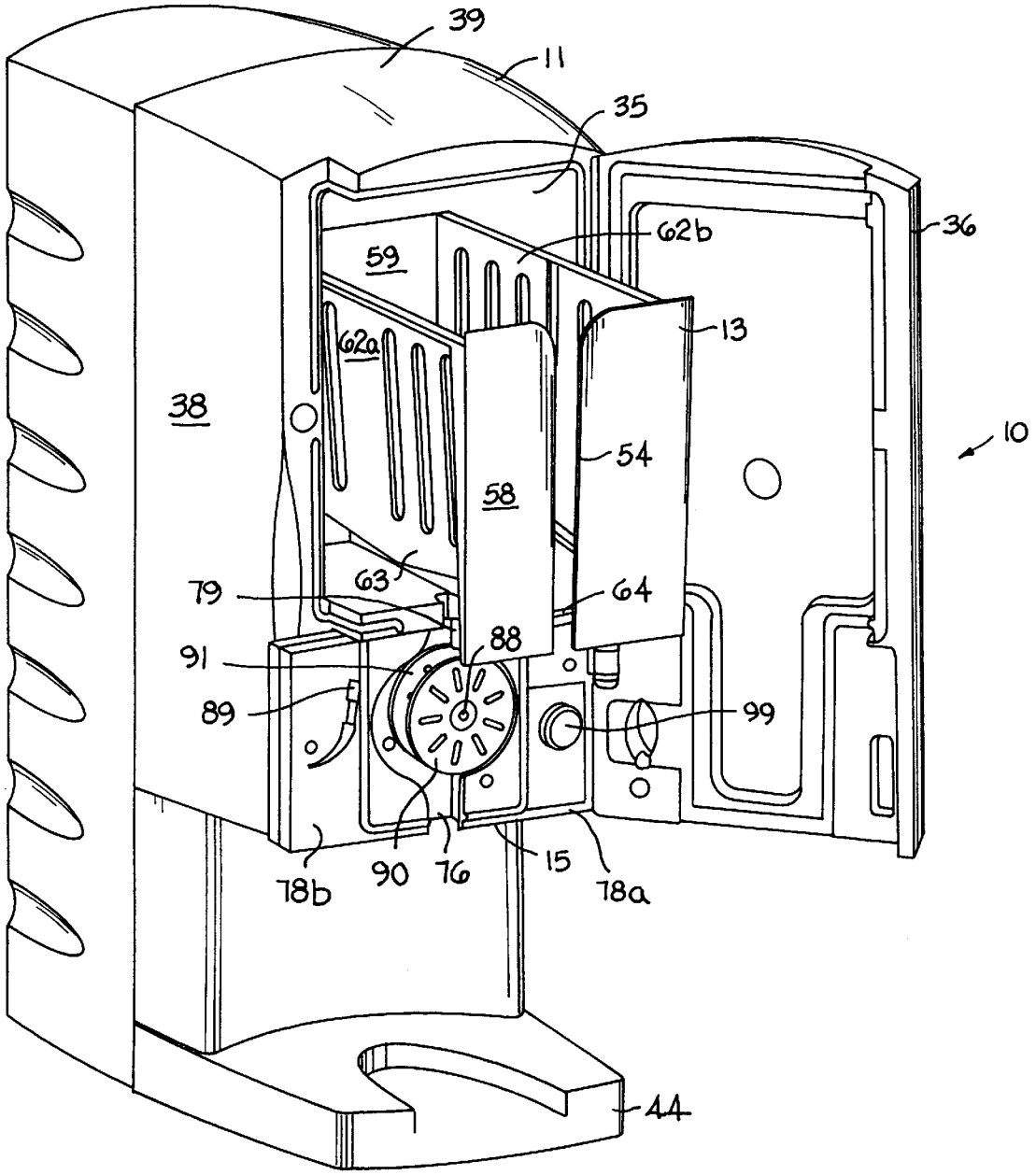
FIG. 1 is perspective view of the heated dispensing apparatus of the present invention.
Figure 2:
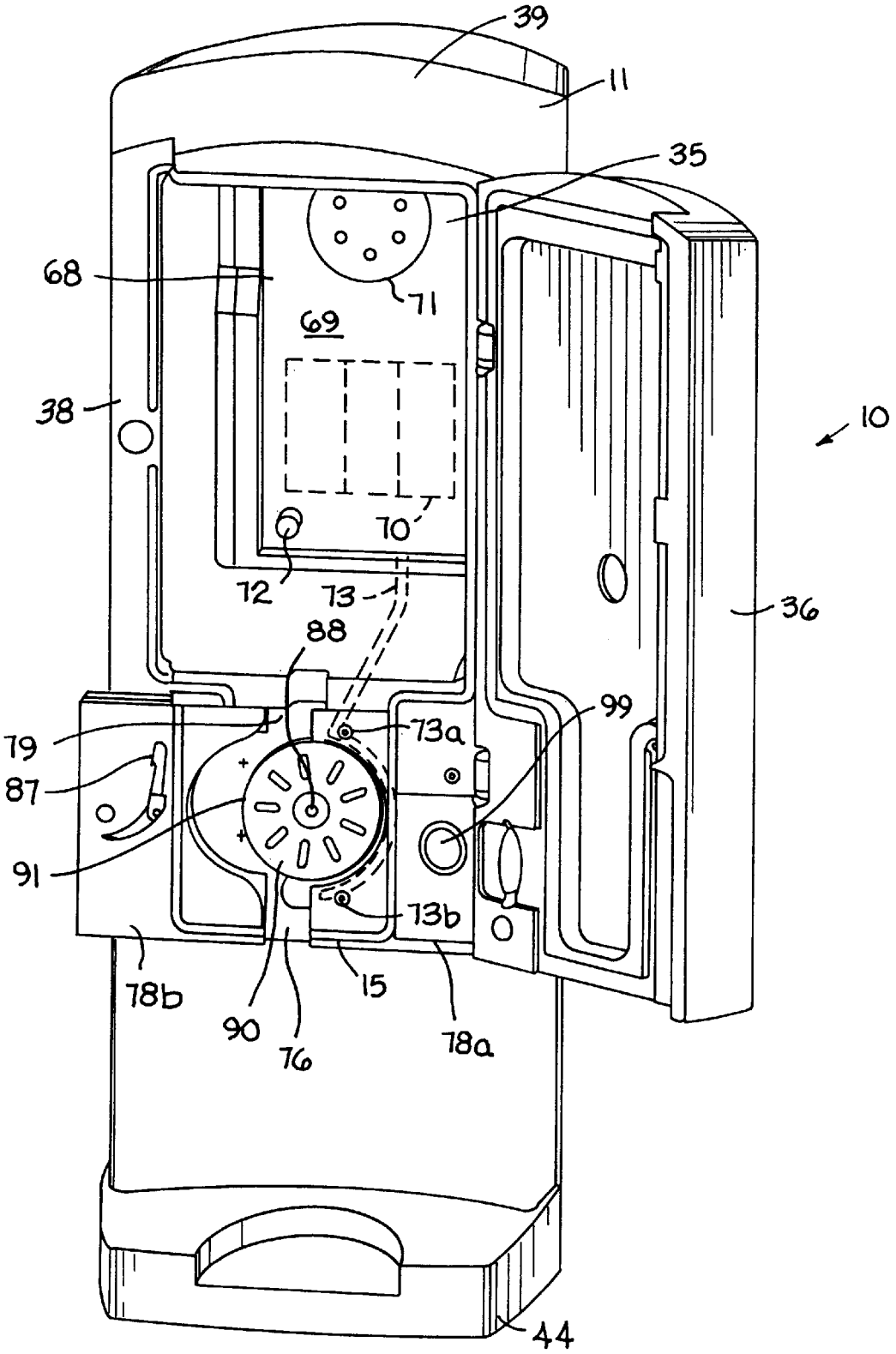
FIG. 2 is an alternate perspective view of the dispensing apparatus of FIG. 1, wherein the product receptacle has been removed to show the heating element.

Referring generally to FIGS. 1 and 2, it may be seen that the dispenser is shown generally by the character numeral 10 and includes a dispenser housing 11, food container basket 13, and pump housing 15. As stated above, the basket 13 is designed to receive a disposable flexible pouch or bag adapted to be attached to a disposable flexible hose that is threaded through a pump assembly mounted within the pump housing 15. It is important to note that the pump housing 15 is preferably mounted toward the front of the dispenser 10, facilitating loading and unloading of the bag and flexible hose. This in effect bifurcates the internal volume of the dispenser 10 such that the heating components (as described below) are located to the rear of the dispenser 10 while the pumping and dispensing components are located toward the front of the dispenser 10.

Figure 3:
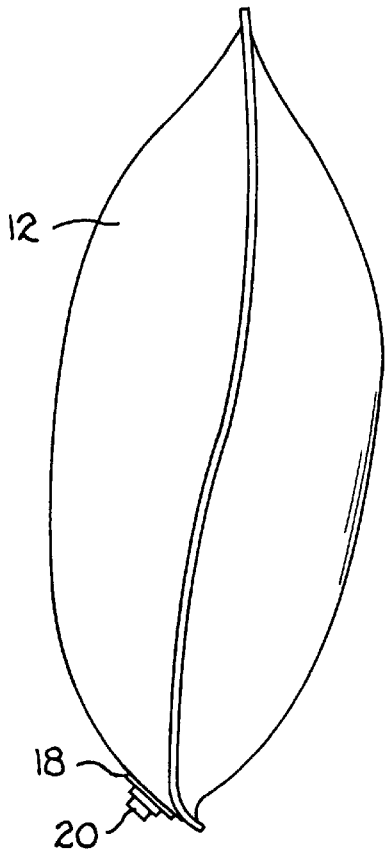
FIG. 3 is a perspective view of a flexible bag used for storing food product that is dispensed by the present invention.
Figure 4:
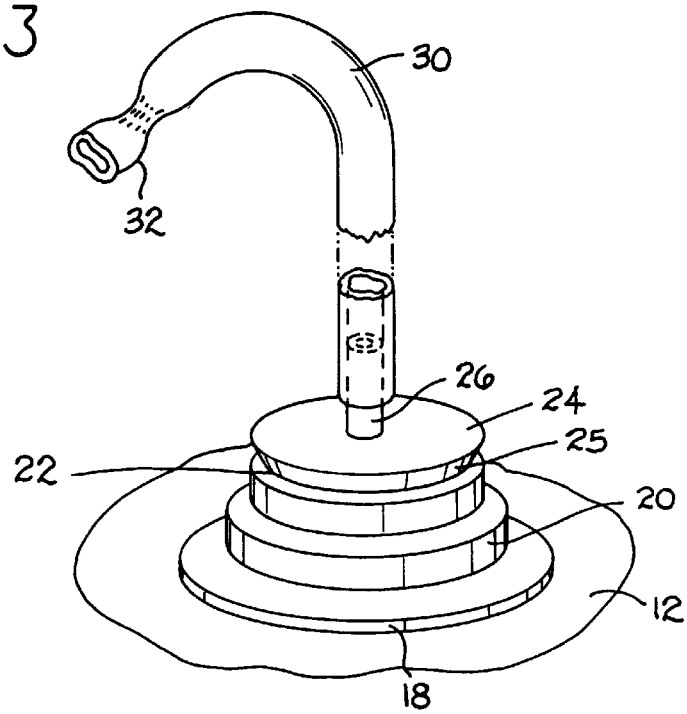
FIG. 4 is a detailed view of the port assembly that attaches to the flexible bag of FIG. 1, allowing for dispensing of the food product.

FIGS. 3 and 4 illustrate the structure of the bag and hose to be used with the dispenser of the present invention. A disposable, thin-walled, flexible bag 12 contains the food product to be dispensed and defines an aperture 18 for dispensing. The flexible bag 12 is made of plastic or another suitable material that can withstand heat, i.e. temperatures in excess of 140 degrees Fahrenheit. Secured to the aperture 18 is a port assembly 20 that is adapted for fluid-tight connection to the flexible bag 12. A cap 24 is locked to the port assembly 20 by a downwardly sloped lip 25 around the circumference of the cap 24, which is tightly received in a complementary groove 22 on the inner surface of the port assembly 20, thereby providing a tight seal between the port assembly 20 and the cap 24.

The cap 24 further includes a nipple 26. A flexible discharge tube 30, having an inner diameter slightly less than the outer diameter of the nipple 26, is secured to the nipple 26, preferably by pressing the nipple 26 into the tube 30. The distal end 32 of the discharge tube 30 is sealed, thereby providing a sealed container of product that is ready for storage and shipment. As will be further explained, once the sealed product bag 12 has been seated in the dispenser, the discharge tube 30 is cut or otherwise opened near its distal end 32, allowing flow of the food product through the discharge tube 30.

Referring back to FIGS. 1 and 2, it may be seen that the dispenser housing, preferably made of a washable, food-grade plastic, includes a base 44, vertical side walls 38, a top 39, and a hinged front door 36. The side walls 38, top 39, and hinged front door 36 define an internal cavity 35 for receiving and storing the product basket 13. This basket 13 is easily inserted into and removed from the internal cavity 35 when the front door 36 of the housing 34 is in an open position.

The basket 13 has a substantially vertical front wall 58, a substantially vertical back wall 59, and left and right side walls 62*a*, 62*b*. The front wall 59 preferably defines a vertical slot 54. The basket 13 also has a bottom wall 63 that is sloped downward and toward the front wall 58. As shown in the Figures, the side and bottom walls 62*a*, 62*b*, 63 are preferably slotted, or otherwise open around the bag, to allow for the heated air to flow unimpeded about the bag. This is an important function in that it is essential that the food stuff in the bag be maintained at a temperature level sufficient to permit free flowing of the food product out of the bag and that the heating is uniform about the bag.

Although not shown in the Figures, the product receptacle alternatively may be a closed container having an outlet opening that is operatively connected to a flexible discharge tube. Such an embodiment is used when the food product is not contained in the preferred product bags. The food product can be poured directly into the receptacle before it is placed within the internal cavity 35 defined by the housing 11.

As shown in FIG. 2, a heating assembly 68 is positioned within the internal cavity 35 and preferably at the rear of the dispenser 10 for heating the food product. The heating assembly 68 includes a housing 69 which encloses an electrical heating element 70. An intake fan 71 draws air into the housing 69. The air passes overs the heating element 70 and is then discharged through a lower opening 72 in the housing 69 into the internal cavity 35 of the dispenser 10. In this manner, heated air is continually circulated into the internal cavity 35 around the basket 13 and food product, maintaining the food product at an elevated temperature.

A thermostat (not shown) may also be included with the heating assembly 68. In combination with a switching mechanism, such a thermostat can be used to selectively activate and deactivate the heating element 70 and fan 71, thereby allowing the food product to be maintained within a specific, predetermined temperature range. For example, many dessert toppings require the temperature to be maintained within a range of 110–120 degrees Fahrenheit.

As stated above, the preferred structure of the dispenser 10 is such that the heating assembly 68 is located to the rear of the dispenser 10, behind the pump base 76. It is essential, however, that the air heated by the heating assembly 68 also be directed to and circulated about the flexible tube 30 carrying and dispensing the viscous material, along the entire length of the tube 30 from the aperture 18 of the bag 12 to the distal end 32 of the discharge tube 30.

Figure 5:
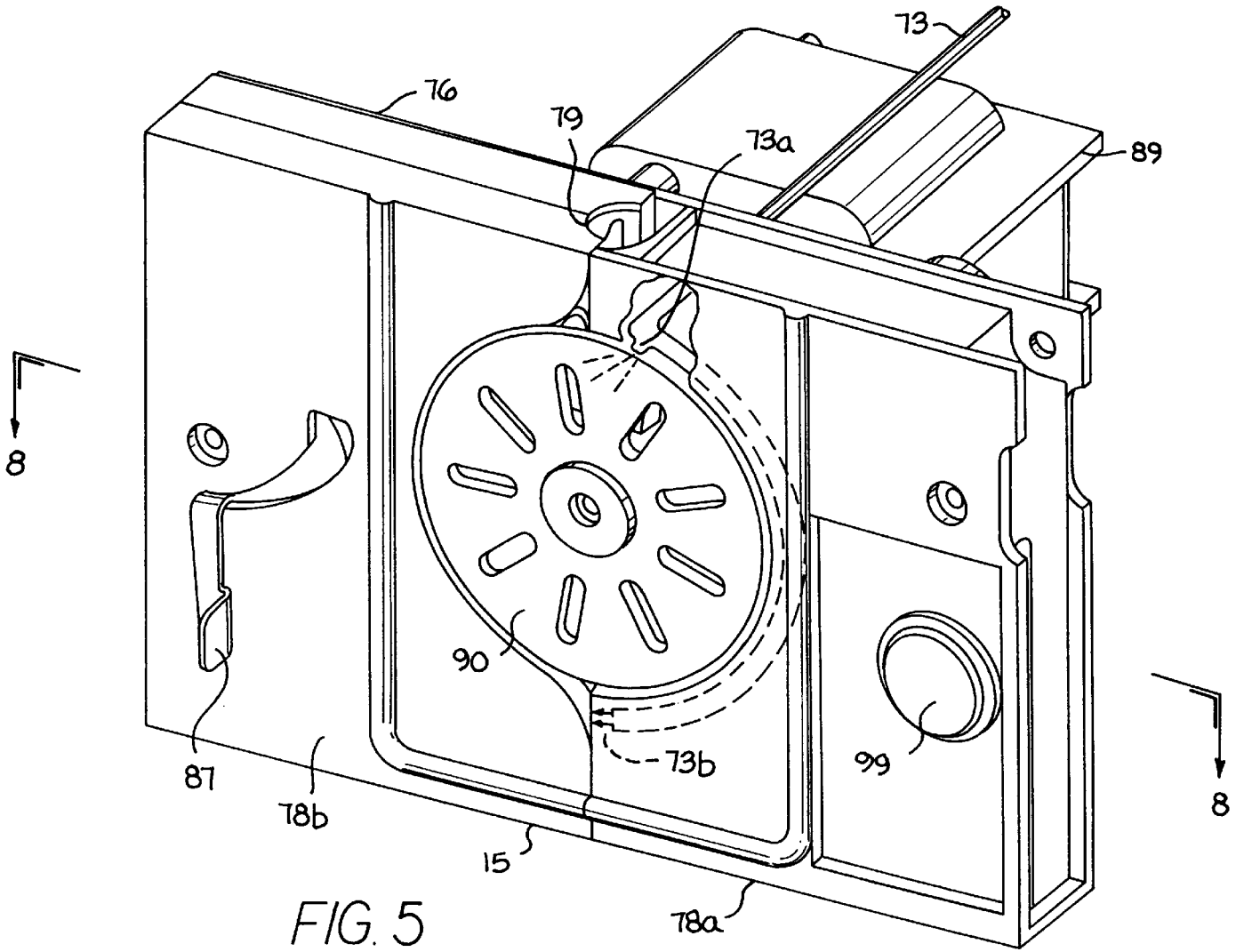
FIG. 5 is a detailed view of the peristaltic pump assembly of the dispensing apparatus of FIG. 1.

Referring to FIGS. 1, 2 and 5, a pump base 76 is mounted beneath the internal cavity 35 and is adapted to support the two-piece pump housing 15. A passage 79 aligned with the outlet opening 64 of the basket 13 extends through the pump housing 15 to receive the flexible discharge tube 30 when the bag 12 of food product is positioned in the basket 13. As illustrated in FIG. 2, a duct 73, shown in dashed lines, extends from within the heating assembly housing 69, under the floor on which the basket 13 rests, and to the pump base 76. This duct 73 directs heated air from the heating assembly 68 along the length of the discharge tube 30, thereby ensuring that the food product contained in the discharge tube 30 is maintained within the predetermined temperature range. As best shown in FIG. 5, the duct 73 has two outlet openings, a first opening 73*a* that directs air onto the discharge tube 30 where it enters the passage 79 defined by the pump housing 15, and a second opening 73*b* that directs air onto the discharge tube 30 near where it exits the pump housing 15. This structure ensures that heated air flows along substantially the entire length of the tube 30 even that portion thereof positioned within the pump housing 15.

Although the duct 73 described above is the preferred structure for directing heated air to the discharge tube 30, other conduits, vents, or similar structures through or around the pump base 76 may be used. The key is to transfer heat by circulating the heated air around or through the pump base 76 to the discharge tube 30, thereby providing uniform heat to the tube 30 and maintaining the product contained in the tube 30 at the proper temperature.

The pump housing 15 includes two pieces 78*a* and 78*b* which cooperate to form a stator. A rotor 90 is mounted for rotation on the pump base 76 and is operably connected to a drive shaft 88 that extends from a motor 89 (shown in FIG. 5). The motor 89 turns the drive shaft 88 and rotor 90 at a preselected speed. The first pump piece 78*a* is stationary while the second pump piece 78*b* is slidably mounted on the pump base 76 to slide toward and away from the rotor 90.

The rotor 90 defines a circumferential groove 91. A plurality of pinch rollers 94 (shown in FIG. 6–7) are mounted in the groove 91 for free rotation. The rollers 94 are evenly distributed around the circumference of the rotor 90. While three pinch rollers 94 are used in this preferred embodiment, more or fewer pinch rollers 94 could be used. The axis of rotation of each pinch roller 94 is parallel to the longitudinal axis of the drive shaft 88 of the rotor 90. Also, the pinch rollers 94 preferably have the same diameter and are arranged with their central axes near the outside edge of the rotor 90 so that a portion of each roller 94 extends radially beyond the edge of the rotor 90. Thus, upon rotation of the rotor 90, the respective rollers 94 will with orbit in a plane about the axis of the drive shaft 88, and if frictionally restrained during rotation of the rotor, with rotate about their own axes.

Figure 8:
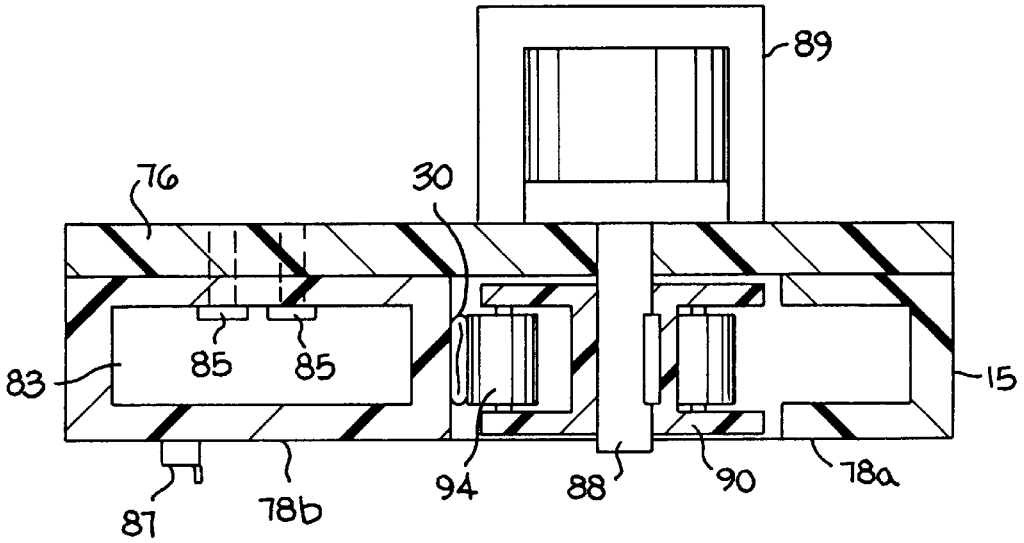
FIG. 8 is a top sectional view taken along line 8—8 of FIG. 5.

As stated, the second pump piece 78*b* is mounted for sliding movement toward or away from the rotor 90. As best shown in FIG. 8, this is preferably accomplished by a plurality of shoulder bolts 85 which pass through slots defined by the rear wall of the second pump piece 78*b*, and screw into the pump base 76. These shoulder bolts 85 are appropriately sized to hold the second pumping piece 78*b* against the pump base 76, but also allow the second pump piece 78*b* to slide laterally on the shoulder bolts 85 as permitted by the slots. Furthermore, in this preferred embodiment, a disk (not shown) is eccentrically rotatably mounted by a shoulder bolt to form a cam within an opening 83 defined by the second pump piece 78*b*. A cam handle 87 extends from the cam to enable a user to rotate the cam. Rotation of this cam causes the second pump piece 78*b* to move toward or away from the rotor 90.

Figure 6:
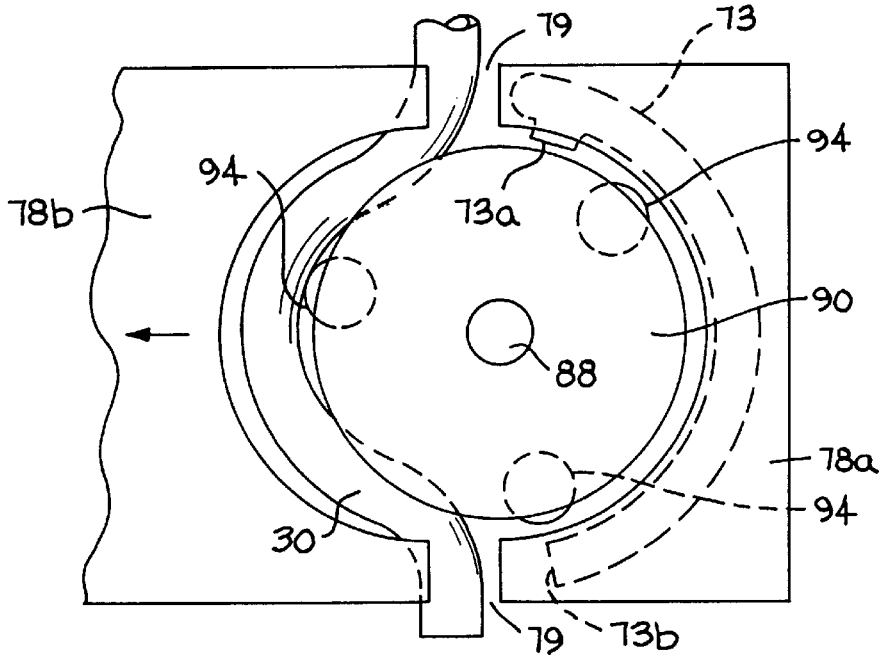
FIG. 6 is a partial front elevation view of the pump assembly of FIG. 5 wherein the pump pieces are in an open position.
Figure 7:
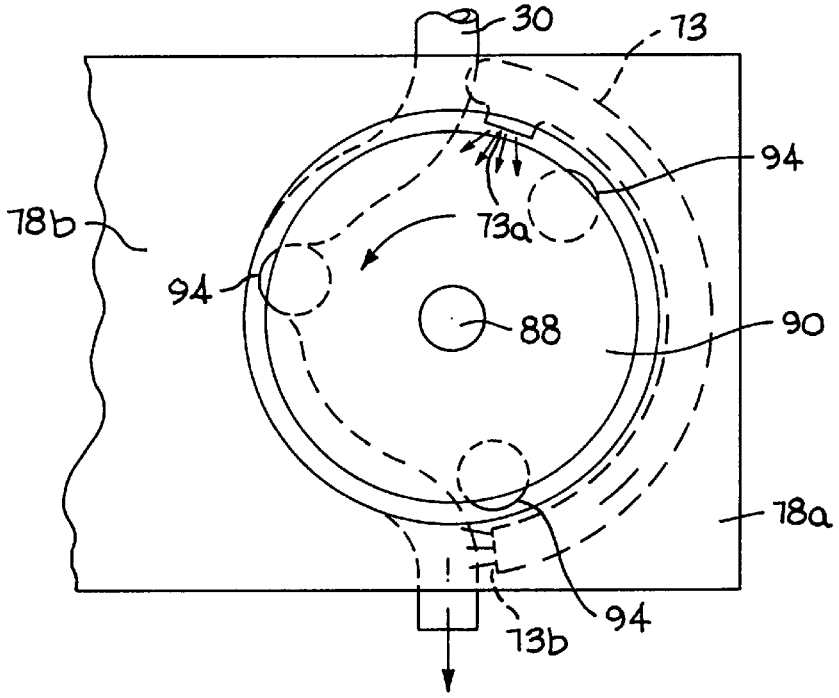
FIG. 7 is a partial front elevation view of the pump assembly of FIG. 5 wherein the pump pieces are in a closed position.

Referring now to FIGS. 6 and 7, as discussed above, the passage 79 for receiving a discharge tube 30 extends between first and second pump pieces 78*a*, 78*b* and around the rotor 90 in the second pump piece 78*b*. With the second pump piece 78*b* slid away from the rotor 90, the discharge tube 30 can be inserted into the passage 79. With the discharge tube 30 in position in the passage 79 and the second pump piece 78*b* slid into a closed position (toward rotor 90 and against the first pump piece 78*a*), the spacing between the passage 79 and the rotor 90 is such that the pinch rollers 94 will compress or pinch the discharge tube 30. As the rotor 90 rotates, respective pinch rollers 94 will contact and pinch the discharge tube 30, forming a peristaltic pump wherein the food product confined within the discharge tube 30 is propelled longitudinally along the discharge tube 30 and out the open end of the discharge tube 30. It is preferable that the individual pinch rollers 94 sufficiently block flow through the discharge tube when the pump is not operating so that a separate valve is not needed. Thus, one function of the pump is to act as a normally closed pinch valve to prevent the heated viscous food product from flowing out of the dispenser when the dispenser is in a non-dispensing state.

To prepare the dispenser 10 for dispensing of the food product, the cam handle 87 is rotated, causing the second pump piece 78*b* to slide into an open position. The front door 36 of the dispenser 10 is opened, and the product basket 13 is removed. A bag 12 of food product is placed in the basket 13 with the discharge tube 30 being fed through the slot 54 and out the outlet opening 64. The basket 13 with its contents is returned to the internal cavity 35 of the housing 11. The discharge tube 30 of the product bag 12 is then passed through the passage 79 of the pump housing 15. The closed end 32 of the tube 30 extends from the passage 79 at the bottom of the pump housing 15. The pump housing 15 is closed by rotation of the cam handle 87, and the second pump piece 78*b* is moved toward the rotor 90 so that the pincher rollers 94 contact the discharge tube 30. The closed end 32 of the discharge tube 30 is then cut off, and the front door 36 is closed. Once the food product has been heated to the predetermined temperature range, the product is discharged by activating the motor 89, which in turns rotates the rotor 90. As shown in FIGS. 3–5, a button 99 on the front of the dispenser 10 activates the motor 89. Once the button 99 is released, the motor 89 shuts off, and the flow of the food product ceases. As an alternative, the dispenser 10 may be equipped with a timing circuit that is triggered by the button 99, providing for activation of the motor 89 for a predetermined time period, thereby dispensing a set quantity of food product. When all of the food product is dispensed, the second pump piece 78*b* is moved away from the rotor, releasing the discharge tube 30. The front door 36 is opened, and the product basket 13 is removed. The product bag 12 is removed from the basket 13 and disposed of, and the basket 13 is ready to receive a new product bag 12. Since the product remains in the bag 12 and discharge tube 30, no part of the food product contacts the interior of the dispenser 10 and thus no clean up of the dispenser or pump is required.

The present invention thus provides a dispensing device that addresses the problems of inconsistent heating, meets all of the objectives stated above, and provides for simple handling of the food product. Moreover, the convective heating system of the present invention eliminates hot conductive surfaces, allowing the dispenser 10, including the basket 13, to be primarily manufactured from food-grade plastics. The removable basket 13 allows for simplified loading and unloading of the food product, and further facilitates cleaning. The structure of the present invention allows the flow of heated air to reach essentially all portions of the dispensing tube and the bag within the basket to ensure the free flow of the food product at all locations within the dispenser.

Figure 9:
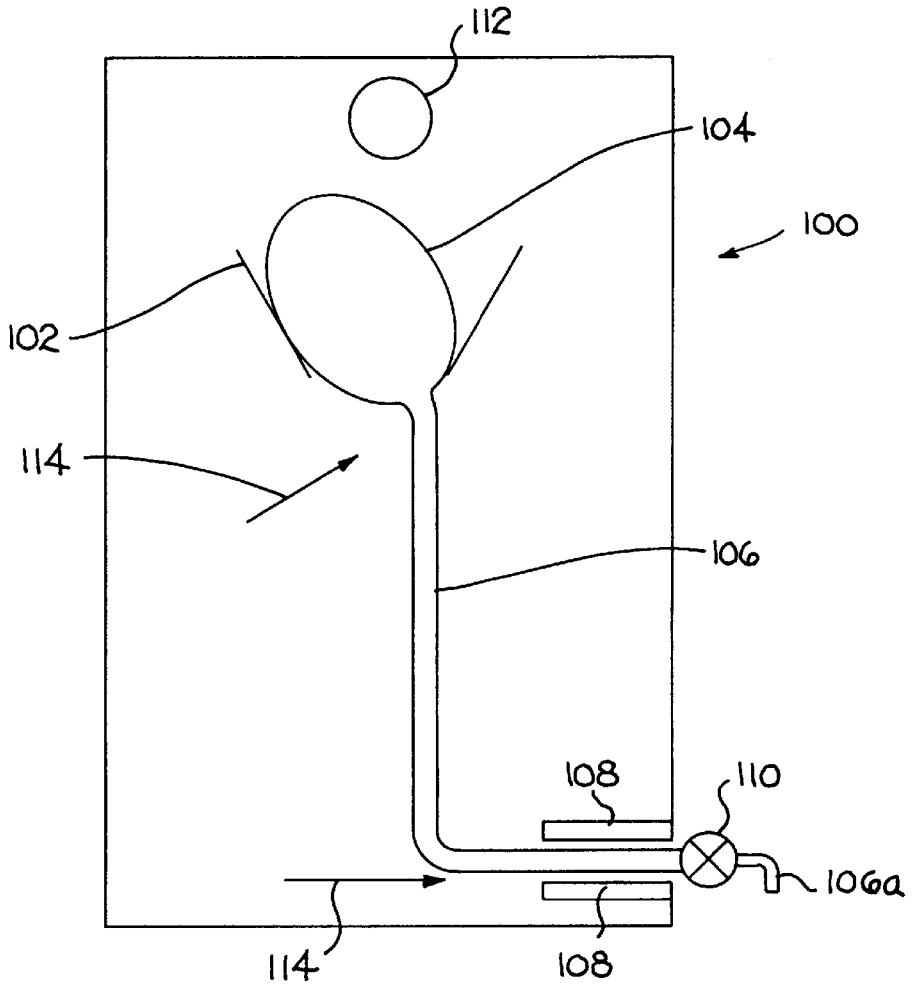
FIG. 9 is a schematic view of a gravity fed dispenser incorporating the present invention.

While a peristaltic pump is a preferred component to cause the heated viscous food stuff to be metered from the dispenser, it should be understood that the beneficial aspects of using an entirely disposable bag and elongated tube along with the direct heating of the elongated tube over substantially its entire length may also be realized in gravity fed types of dispensers. Such gravity fed dispensers would preferably use a simple, normally closed pinch type valve that manually opens and closes the tube. The schematic of FIG. 9 illustrates a gravity fed type of dispenser 100 with a receptacle 102 for receiving a bag 104 of viscous food product. An elongated tube 106 is attached to the bag 104 and threaded through tube support members 108 into a valve structure 110 exposing the distal end 106*a* of tube 106. As before the tube is cut or otherwise opened at its distal end. Valve 110 is normally biased into a closed position, but is manually operable by a user into an open position for the dispensing of the food product under gravity. However, as applicant has noted above with respect to dispensers with pumps, the tube becomes cooler nearer the distal end due to the insulation provided by the support members, allowing the food product to thicken, thus often impeding the free flow of the viscous food product in this region of the tube. To ensure the continuous free flow of the food product from the bag 104 through the entire length of the tube 106, applicant has determined that the heat be directed along the entire length of the tube 106 to ensure that the viscosity of the food product allows the free flow needed. As illustrated schematically in FIG. 9, a heat assembly 112 creates heat energy that may be directed to the bag 104 and the tube 106 by conduction or preferably convection as shown by arrows 114. When done convectionally, it is important that the circulation of heated air be directed into the support members 108 so that the tube is heated almost to its distal end. Valve 110 can be any of a variety of pinch type valves that is operated by a user so that the user can dispense a predetermined amount of food product. Although it is preferable to manually open the valve, there may be situations in which it is desirable to use an automatic valve such as a solenoid operated valve that is open for a preset time period.

It is understood that changes may be made in the construction and arrangement if the various components of the present invention. For example, while the preferred peristaltic pump is of the type described, other and different peristaltic pumps, such as a sliding disk type of peristaltic pump, may also be used without departing from the spirit and scope of the invention as defined in the appended claims. Also, while the preferred structure for directing heated air to the discharge tube 30 is a duct 73 that extends from the heating assembly 68 through the pump base 76, other conduits, vents or other structures may be used to circulate the heated air around or through the pump base 76 to the discharge tube 30 without departing from the spirit and scope of the invention as defined in the appended claims.

What is claimed is:

1. A dispenser for dispensing a viscous food product, comprising (a) a substantially enclosed housing defining an interior cavity and a closable entry into said cavity;

(b) a removable bag enclosing a viscous food product positioned within said housing;

(c) a tube of predetermined length removably connected to said bag, communicating with said viscous food product, and providing a passageway for said food product to a position exterior to said dispenser; said tube being enclosed by support members over a portion of its length;

(d) a component for closing said tube when said food product is not being moved therethrough; and (e) a heating assembly applying heat to said bag and along substantially all of the predetermined length of said tube so as to maintain the viscous food product at a predetermined elevated temperature and keep the viscous food product in a free-flowing state.

2. The dispenser of claim 1 including structure essentially dividing said interior cavity into a front volume and a rear volume, and further comprising a channel communicating between said front volume and said rear volume, thereby allowing the passage of heated air from said rear volume through said channel to said front volume.

3. The dispenser of claim 2 in which said heating assembly comprises a heater element and a fan for moving air heated by said element about said rear volume and through said channel to said front volume.

4. The dispenser of claim 3 in which said component is a peristaltic pump which opens and closes said tube to the passage of the viscous food product and selectively moves the product from said bag along said tube to said exterior position.

5. The dispenser of claim 4 including a removable receptacle positioned within said internal cavity for receiving said bag, said receptacle having openings therein for the passage of heated air to said bag.

6. A dispenser for food products which are to be dispensed at elevated temperatures, comprising:

(a) a receptacle;

(b) a container containing food product to be dispensed from said dispenser, said container connected to a length of flexible discharge tube extending through an outlet opening in said container;

(c) a heating assembly for heating air within said dispenser and circulating the heated air about the container thereby maintaining the temperature of the product at a predetermined level sufficient to allow the food product to flow freely; and (d) a peristaltic pump operably connected to said flexible discharge tube for moving said food product, said heating assembly circulating heated air along substantially the entire length of said tube, including about a region of said tube within said pump to maintain temperature of product within said tube at said predetermined level.

7. The dispenser of claim 6 including a frame that defines a cavity for receiving said receptacle, wherein said heating assembly includes a fan mounted in said cavity and a heating element, said fan circulating air heated by said heating element around said container and about essentially the entire length of said discharge tube including said region within said pump.

8. The dispenser of claim 7 in which said receptacle has substantially vertical side walls and a sloped bottom wall, said sloped bottom wall terminating at said outlet opening.

9. The dispenser of claim 8 in which said walls define a plurality of openings for allowing heated air to circulate about said container.

10. The dispenser of claim 9 including a channel extending from said frame to said pump through which said fan directs heated air onto said region of said tube within said pump.

11. An apparatus for the delivery of viscous food product maintained at an elevated temperature, comprising:

(a) a housing;

(b) a receptacle positioned within said housing, said receptacle being adapted to receive a container of viscous food product, and said receptacle having an opening for receiving said food product and an outlet for dispensing said food product;

(c) a peristaltic pump;

(d) a length of flexible tube operatively communicating with the outlet of said receptacle and having a distal open end positioned to the exterior of said housing, said pump moving said viscous food product from said container through said flexible tube and out the distal open end of said flexible tube; and (e) a heating assembly positioned within said frame for heating air within said housing and circulating the heated air about said container and along said length of said flexible tube.

12. The apparatus of claim 11 in which said heating assembly comprises a fan and a heating element.

13. The apparatus of claim 12 in which said receptacle has substantially vertical side walls and a sloped bottom wall defining said outlet.

14. The apparatus of claim 13 in which said side walls define a plurality of openings for allowing heated air to circulate about said container of food product.

15. The apparatus of claim 11 in which said heating assembly and said peristaltic pump are respectively positioned in a rear portion and a front portion of said housing, said flexible tube being threaded through said pump and leaving a portion thereof located in said front portion, and a channel placing said front and rear portions in communication, thereby allowing heated air to pass from said rear portion through said channel to said front portion.

* * * * *